United States Patent [19]

Ishii et al.

[11] Patent Number: 4,986,235

[45] Date of Patent: Jan. 22, 1991

[54] OIL PAN FOR INTERNAL COMBUSTION ENGINE

[75] Inventors: Akira Ishii; Takashi Terui, both of Yokohama; Toyoki Hiraoka, Tokyo; Yuichi Murakami, Yokohama, all of Japan

[73] Assignee: Nissan Motor Co., Ltd., Yokohama, Japan

[21] Appl. No.: 501,119

[22] Filed: Mar. 29, 1990

[30] Foreign Application Priority Data

Apr. 3, 1989 [JP] Japan ..... 1-81568

[51] Int. Cl.[5] ..... F16N 31/00

[52] U.S. Cl. ..... 123/195 C; 184/106; 123/196 R

[58] Field of Search ..... 123/196 R, 195 C; 184/106

[56] References Cited

U.S. PATENT DOCUMENTS 4,270,497 6/1981 Valerio ..... 123/195 C
4,519,348 5/1985 Hamilton ..... 184/106
4,848,293 7/1989 Sasada et al. ..... 184/106
4,938,184 7/1990 Martin et al. ..... 184/106

*Primary Examiner*—E. Rollins Cross
*Attorney, Agent, or Firm*—Foley & Lardner, Schwartz, Jeffery, Schwaab, Mack, Blumenthal & Evans

[57] ABSTRACT

An oil pan for an internal combustion engine having an engine lubrication system. The oil pan comprises a shallow bottom section and a sump section. A guide plate is secured at an inner surface to which a crankshaft splashes lubrication oil carried into the shallow bottom section. The guide plate having an inclined and a guide parts extends generally along the axis of the crankshaft and extends generally parallel with a horizontal plane. The inclined part which gradually becomes high in level in the direction toward the sump is continuously connected to the inclined part to be formed in a generally arcuate shape. Therefore, the splashed oil at the inner surface cannot over the guide plate, and the oil is positively returned into the sump section by the guide plate. Accordingly, lubrication in this engine is smoothly carried out without causing a lack of the oil in the sump section.

16 Claims, 4 Drawing Sheets

OIL PAN FOR INTERNAL COMBUSTION ENGINE

BACKGROUND OF THE INVENTION

1. Field of the Invention

This invention relates to an oil pan for an internal combustion engine, and more particularly to improvements in an oil pan structure with which the lubrication oil is positively returned into sump.

2. Description of the Prior Art

It is well known that an internal combustion engine is provided with an oil pan as shown in FIG. 3. In FIG. 3, a multiple cylinder internal combustion engine 1' comprises a cylinder block 2' which rotatably supports a crankshaft 3'. An oil pan 4' is connected to the under surface of the cylinder block 2'. The oil pan 4' includes a sump section 5' and a shallow bottom section 6' which are disposed along the axis of the crankshaft 3' and under the crankshaft 3'. A baffle plate 7' having a cutout 8' is installed in the sump section 5'. An oil sucking section 9' which has an oil strainer 10' at its end is inserted into the sump section 5' and dipped in lubrication oil through the cutout 8', so that the oil sucking section 9' can suck the lubrication oil.

In recent years, there has been a tendency that a vehicular engines are smaller and more light-weight. Accordingly, the oil pan 4' has become shortened in height. Additionally, counterweights 11' installed in the crankshaft 3' have become located slightly above the oil pan 4'. Therefore, when the oil level 13' of the lubrication oil in the oil pan 4' is changed into an inclined condition under inertial force caused by an outer force such as acceleration, deceleration, turning of the vehicle, he lubrication oil flows into the shallow bottom section 5'. The lubrication oil is then splahsed by blown air pressure caused by the rotation of the counterweights 11'. Under this condition, in case the oil level 13' is further, inclined in the direction to cause the lubrication oil to flow into the shallow bottom section 6', the counter weight 11', which is not dipped in the oil under the normal conditions, becomes dipped in the lubrication oil as shown in FIGS. 3 and 4. This causes the counterweight 11' to splash the oil. Therefore, the amount of the oil returned into the sump 5' is reduced, and therefore the oil level 13' is lowered. This causes a problem that an oil pump (not shown) cannot supply the oil to lubricate the required sections. In contrast, it has been proposed that the guide plate 23' returning the splashed oil toward the oil level is installed at a side surface 22' of an oil pan 21' as shown in FIGS. 5 and 6. Such an arrangement is disclosed, for example, in U.S. Pat. No. 4,270,497. However, since the guide plate 23' only downwardly guides the splashed oil and does not guide the oil from a shallow bottom section 24' toward a sump 25', a lack of the lubrication oil in the sump 25' is possibly caused under the influence of the oil viscosity or like.

SUMMARY OF THE INVENTION

It is therefore an object of the present invention to provide an oil pan for an internal combustion engine with which the oil splashed by a crankshaft is positively fed from a shallow bottom section into a sump.

This oil pan for an internal combustion engine comprises a shallow bottom section fixedly disposed under a cylinder block of the engine. The shallow bottom section defines therein a first space in which at least a part of a crankshaft of the engine is disposed. A sump section is fixedly disposed under the cylinder block and integral with the shallow bottom section. The sump section defines therein a second space communicated with the first space. A lower part of the second space is lower in level than that of the first space. A guide plate for lubrication oil is fixed to an inner surface of the shallow bottom section and extends generally along the axis of the crankshaft. The inner surface is located in a side to which lubrication oil is splashed by the crankshaft under rotation. The guide plate has an inclined part, and a guide part which is continuously connected with the inclined part. The inclined part gradually becomes high in level in a direction toward the second space. The guide part extends toward the second space to guide lubrication oil to the second space.

With the above arrangement, since the guide plate is fixed to the inner surface of the shallow bottom section to receive the splashed oil, the guide plate prevents the oil from being splashed over the guide plates. Additionally, since the guide plate has an inclined part which gradually becomes high in level in a direction toward the sump section, the force directed toward the sump section is applied to the oil which has been influenced only by the force acting in the tangential direction of the rotation of the crankshaft when the oil strikes the guide plate. Furthermore, the oil is guided into the sump along the guide part which is continuously connected to the inclined part.

DETAILED DESCRIPTION OF THE INVENTION

Figure 1:
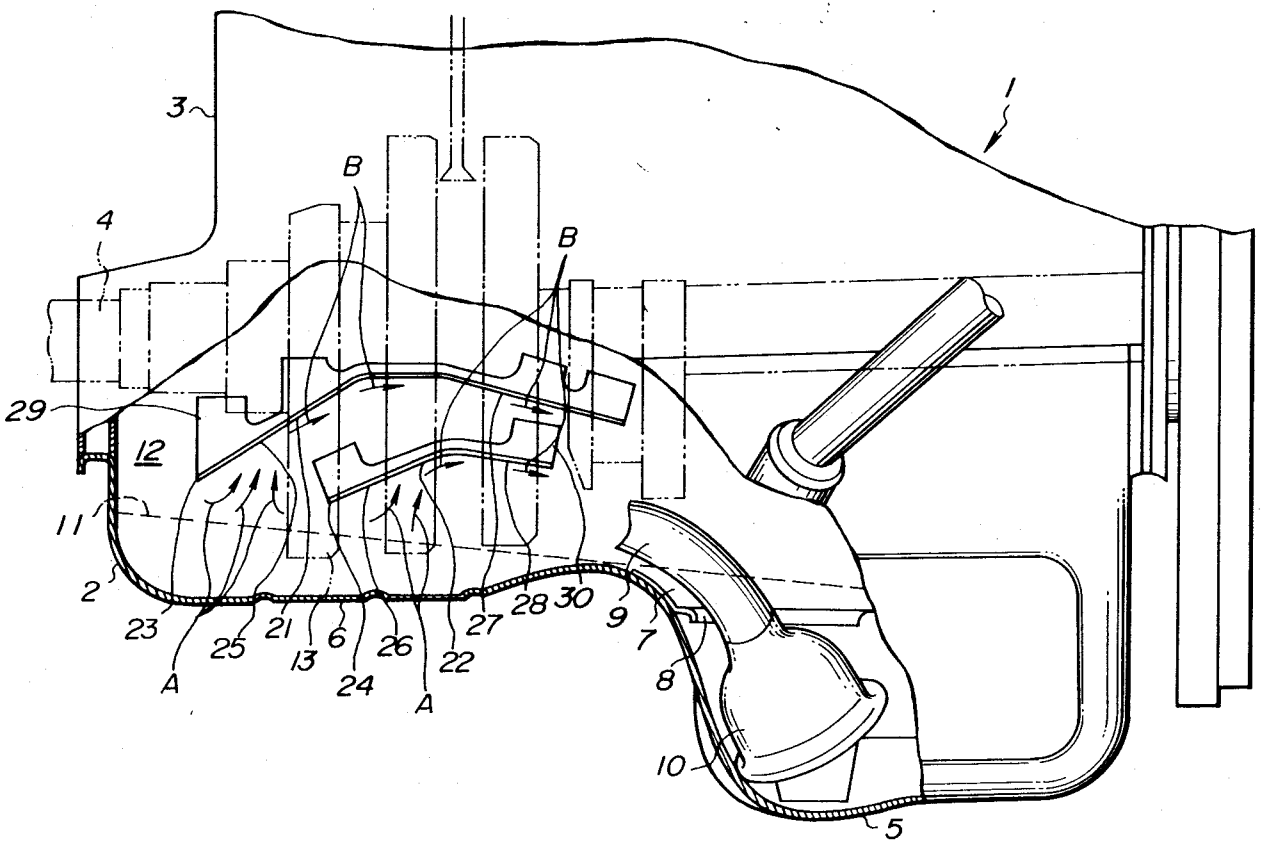
FIG. 1 is a side view, partly in section, of an embodiment of an oil pan for an internal combustion engine according to the present invention.
Figure 2:
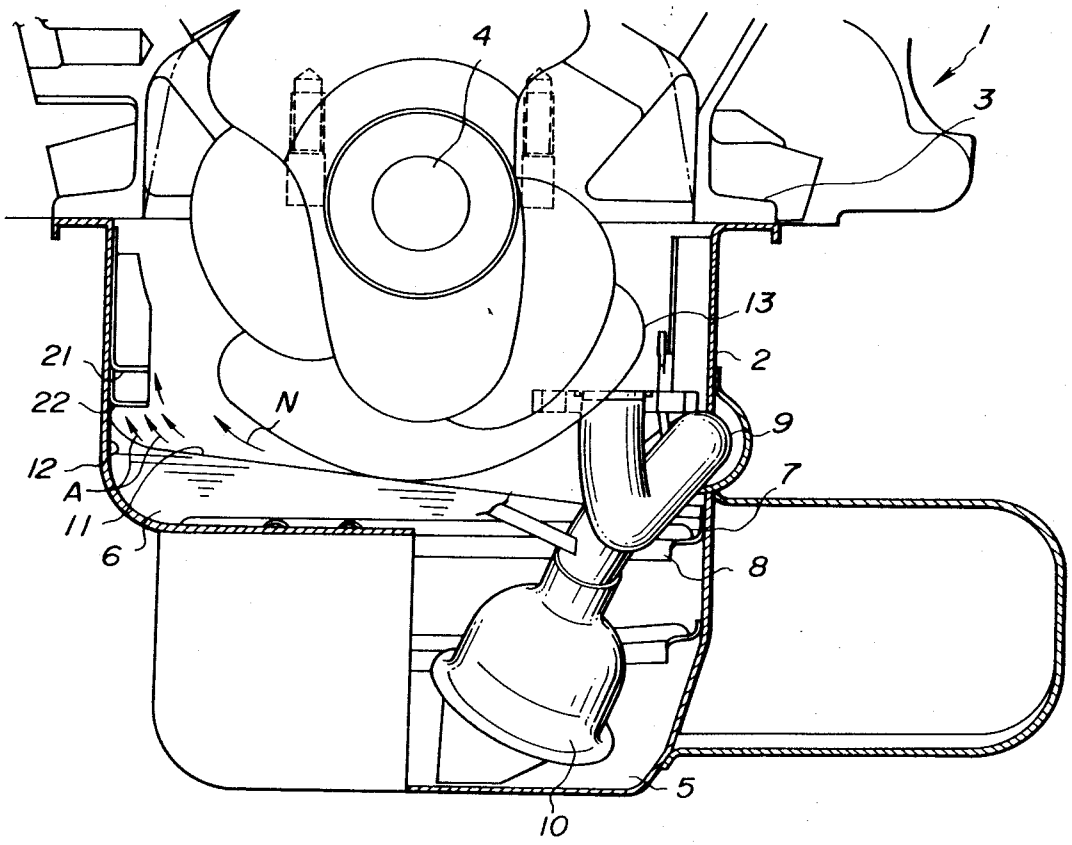
FIG. 2 is a front view, partly in section, of a lower part of the engine of FIG. 1.
Figure 3:
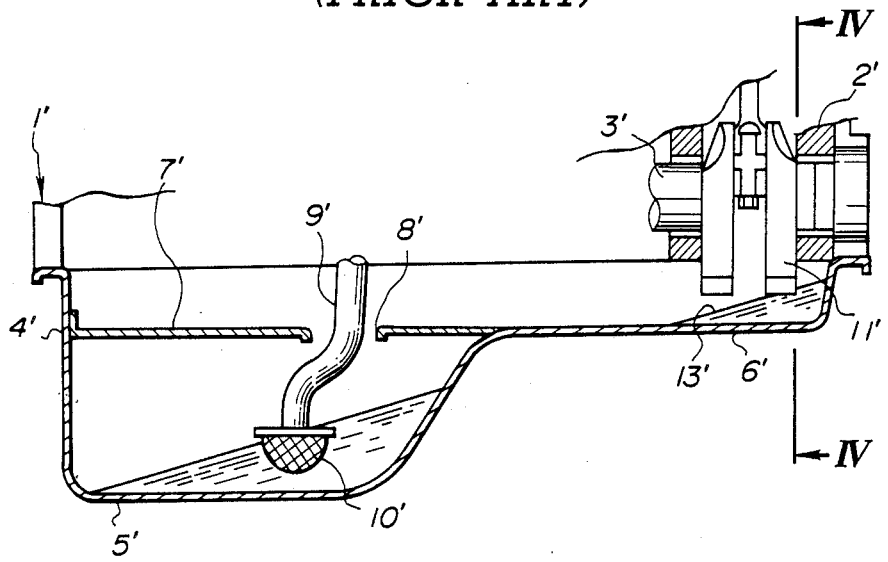
FIG. 3 (PRIOR ART)
FIG. 3 is a side sectional view of a conventional oil pan for an internal combustion engine.
Figure 4:
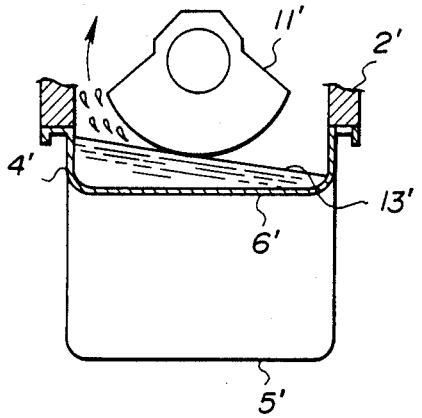
FIG. 4 (PRIOR ART)
FIG. 4 is a cross-sectional view taken in the direction of arrows substantially along the line IV—IV of FIG. 3.
Figure 5:
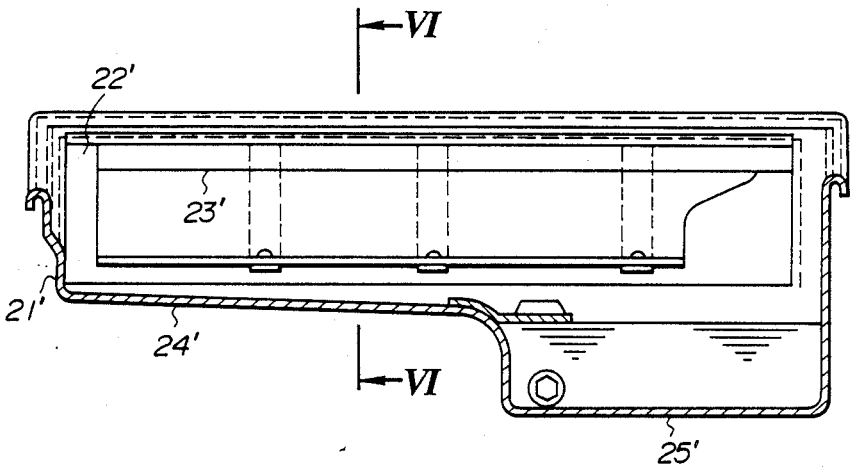
FIG. 5 (PRIOR ART)
FIG. 5 is a side sectional view of another conventional oil pan for an internal combustion engine having a guide plate.
Figure 6:
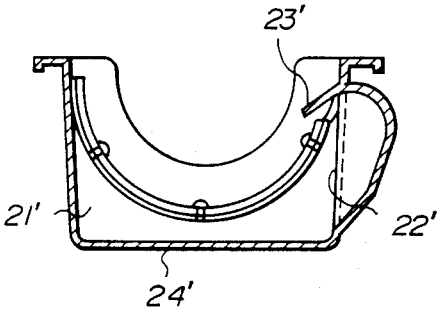
FIG. 6 (PRIOR ART)
FIG. 6 is a cross-sectional view taken in the direction of arrows substantially along the line VI—VI of FIG. 5.

Referring now to FIGS. 1 to 2, an embodiment of an oil pan for an internal combustion engine 1 according to the present invention is illustrated by the reference numeral 2. The oil pan 2 is fixedly connected to the under surface of a cylinder block 3 which rotatably supports a crankshaft 4. The oil pan 2 comprises a sump section 5 which forms a sump or a space under the rear side of the cylinder block 3. A shallow bottom section 6 is disposed forward of the sump section 5 to form a space under the front side of the cylinder block 3. The sump section 5 and the shallow bottom section 6 are aligned along the crankshaft 4 and integrally connected with each other. A bottom of the sump defined by the sump section 5 is located lower in level than the space defined by the shallow bottom section 6. A baffle plate 7 having a cutout 8 is generally horizontally formed at the sump section 5. An oil sucking section 9 has an oil strainer 10 at its tip end and is disposed in the sump section 5 through the cutout 8. The oil sucking section 9 is dipped in lubrication oil collected in the sump section 5 so that the lubrication, oil is sucked into an oil pump (not shown) and supplied to the sections requiring lubrication.

As shown in FIG. 2, the crankshaft 4 is rotated clockwise (indicated by an arrow N) as viewed from the front direction of the engine 1. A guide plate 21 is installed on a left inner surface 12 of the shallow bottom section 6 as viewed from the front direction of the engine 1. The left inner surface 12 is located at a side against which a major part of the splashed lubrication oil is thrown. Additionally, the guide plate 21 is located in a position to which a major part of the splashed lubrication oil is thrown. An end 23 of the guide plate 21 is positioned over an oil level 11 in the shallow bottom section 6. The guide plate 21 extends generally along the axis of the crankshaft and extends parallel with a horizontal plane containing the axis of the crankshaft. The guide plate 21 is in a generally arcuate shape in cross-section as viewed from the side direction of the engine 1, so that the opposite ends of the guide plate 21 are downwardly directed. The guide plate 21 comprises an inclined part 25 which gradually increases in level in the direction toward the sump or the space defined by the sump section 5. A front side end of the inclined part 25 is lower in level than a rear side end of the inclined part 25 to which a guide part 27 is integrally and smoothly connected. The guide part 27 is located nearer to the sump than the inclined part 25. The guide part 27 extends toward the sump to guide lubrication oil to the sump. The guide part 27 gradually becomes low in level in the direction toward the sump section 5 to be formed in a generally arcuate shape in cross-section as viewd from the side direction of the engine 1. The inclined part 25 and the guide part 27 horizontally project from the inner surface 12. A connecting part 29 of the guide plate 21 upwardly extends along the left inner surface 12 and laterally extends toward the sump section 5. The connecting part 29 is integrally and angularly connected with the inclined part 25 and the guide part 27. The guide plate 21 is generally L-shaped in cross-section as viewed from the front direction of the engine 1. The guide plate 21 is fixedly connected at the connecting part 29 with the left inner surface 12 of the shallow bottom section 6 by spot welding or the like.

A guide plate 22 similar to the guide plate 21 is installed on the left inner surface 12. The guide plate 22 is formed smaller than the guide plate 21. The guide plate 22 is located lower than the guide plate 21 to extend generally parallelly with the guide plate 21. An end 24, an inclined part 26, a guide part 28, and a connecting part 30 of the guide plate 22 correspond to the end 23, the inclined part 25, the guide part 27, and the connecting part 29 of the guide plate 21, respectively. The end 24 of the guide plate 22 is positioned over the oil level 11.

While the guide plates 21, 22 have been shown and described to be installed on the inner surface of the shallow bottom section 6, it will be understood that the guide plates 21, 22 may extend to the inner surface of the sump section 5.

The manner of operation of the thus arranged oil pan will be discussed hereinafter.

When lubrication oil in the oil pan 2 is carried into the shallow bottom section 6 by the inertial force caused by acceleration, deceleration, turning or the like of the vehicle, counterweights 13 of the crankshaft 4 splash the lubrication oil in the shallow bottom section 6 as indicated by arrows A in FIGS. 1 and 2. However, since the guide plates 21, 22 are provided at the inner surface 12 of the shallow bottom section 6 to receive the splashed oil, the guide plates 21, 22 prevent the oil from being splashed over the guide plates 21, 22. Furthermore, the oil received at the guide plates 21, 22 flows along the guide plates 21, 22 and is positively returned from the shallow bottom section 6 into the sump section 5 under the force which has been applied to the splashed oil with the counterweights 13 and changed its direction by the inclined parts 25, 26. Such force is indicated by arrows B in FIG. 1.

Thus, the oil is positively returned into the sump section 5 by the guide plates 21, 22 even if the counterweights 13 splash the oil carried into the shallow bottom section 6 by the inclination of the oil level 11. Accordingly, the oil level 11 is kept in an adequate condition. Therefore, the lubrication is smoothly carried out in the engine 1.

While the guide plate has been shown and described as being formed in the generally arcuate shape, it will be understood that the guide part may be formed into other shapes if the inclined parts and the guide part are continuous to each other.

What is claimed is:

1. An oil pan for an internal combustion engine, comprising:

a shallow bottom section fixedly disposed under a cylinder block of the engine, said shallow bottom section defining therein a first space in which at least a part of a crankshaft of the engine is disposed;

a sump section fixedly disposed under the cylinder block and integral with said shallow bottom section, said sump section defining therein a second space communicated with said first space, a lower part of said second space being lower in level than that of said first space; and a guide plate for lubrication oil, fixed to inner surface of said shallow bottom section and extending generally along an axis of said crankshaft, said inner surface being located in a side to which lubrication oil is splashed by said crankshaft under rotation, said guide plate having an inclined part, and a guide part which is continuously connected with said inclined part and located nearer to said second space than said inclined part, said inclined part gradually becoming high in level in a direction toward said second space, said guide part extending toward said second space to guide lubrication oil to said second space.

2. An oil pan as claimed in claim 1, wherein said guide plate guide part gradually becoming low in level in a direction toward said sump section.

3. An oil pan as claimed in claim 1, wherein said guide plate inclined part has a first end and a second end which is continuously connected to said guide plate guide part, said first end being lower in level than said second end.

4. An oil pan as claimed in claim 1, wherein said inner surface of said shallow bottom section is located on a side against which a major part of the splashed lubrication oil is thrown.

5. An oil pan as claimed in claim 1, wherein said guide plate is located in a position to which a major part of the splashed lubrication oil is thrown.

6. An oil pan as claimed in claim 1, wherein said guide plate extends generally parallel with a horizontal plane containing the axis of the crankshaft.

7. An oil pan as claimed in claim 1, wherein said guide plate is in a generally arcuate shape in cross-section.

8. An oil pan as claimed in claim 1, wherein said inclined part of said guide plate is in a generally arcuate shape in cross-section.

9. An oil pan as claimed in claim 1, wherein said sump section and shallow bottom section are arranged along the axis of the crankshaft.

10. An oil pan as claimed in claim 1, wherein said shallow bottom section is shaped to guide lubrication oil into said sump section.

11. An oil pan as claimed in claim 1, wherein said oil pan is fixedly connected to the cylinder block which rotatably supports the crankshaft.

12. An oil pan as claimed in claim 1, wherein said guide plate has a connecting part which upwardly extends along the oil pan side surface, and connects said guide plate with said shallow bottom section inner surface.

13. An oil pan as claimed in claim 1, wherein said connecting part is fixedly connected to said inner surface by spot welding.

14. An oil pan as claimed in claim 1, wherein said guide plate is in a generally L-shaped in cross-section.

15. An oil pan as claimed in claim 1, wherein said guide plate is located over a level of the lubrication oil in said shallow bottom section.

16. An oil pan as claimed in claim 1, further comprising a baffle plate which is disposed in said sump section, said baffle plate being formed with a cutout through which an oil sucking section is dipped in the lubrication oil of said sump section.

* * * * *